US011578453B2

(12) United States Patent
Leonard et al.

(10) Patent No.: US 11,578,453 B2
(45) Date of Patent: Feb. 14, 2023

(54) FAULT DETECTION FOR A WATER LEVEL DETECTION SYSTEM OF A WASHING MACHINE APPLIANCE

(71) Applicant: Haier US Appliance Solutions, Inc., Wilmington, DE (US)

(72) Inventors: Ryan Ellis Leonard, Louisville, KY (US); Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 126 days.

(21) Appl. No.: 16/830,462

(22) Filed: Mar. 26, 2020

(65) Prior Publication Data

US 2021/0301455 A1 Sep. 30, 2021

(51) Int. Cl.

| | |
|---|---|
| ***D06F 39/08*** | (2006.01) |
| ***D06F 34/14*** | (2020.01) |
| ***D06F 33/34*** | (2020.01) |
| ***D06F 103/14*** | (2020.01) |
| ***D06F 103/18*** | (2020.01) |
| ***D06F 105/02*** | (2020.01) |

(52) U.S. Cl.

CPC ..... *D06F 39/087* (2013.01); *D06F 33/34* (2020.02); *D06F 34/14* (2020.02); *D06F 39/088* (2013.01); *D06F 2103/14* (2020.02); *D06F 2103/18* (2020.02); *D06F 2105/02* (2020.02)

(58) Field of Classification Search

CPC .... D06F 33/34; D06F 39/087; D06F 2103/10; D06F 2103/14

See application file for complete search history.

(56) References Cited

U.S. PATENT DOCUMENTS

| | | | | |
|---|---|---|---|---|
| 4,987,627 | A | 1/1991 | Cur | |
| 5,577,283 | A | 11/1996 | Badami et al. | |
| 5,619,614 | A | 4/1997 | Payne et al. | |
| 6,374,444 | B2 | 4/2002 | Skrippek et al. | |
| 6,715,216 | B1 * | 4/2004 | Salameh | D06F 37/42 34/570 |
| 6,842,928 | B2 | 1/2005 | Yang et al. | |
| 7,162,759 | B2 | 1/2007 | Weinmann | |
| 7,484,258 | B2 | 2/2009 | Kim et al. | |
| 7,739,764 | B2 | 6/2010 | Zhang et al. | |

(Continued)

FOREIGN PATENT DOCUMENTS

| | | | |
|---|---|---|---|
| BR | PI0902470 | A2 | 4/2010 |
| BR | PI0904273 | A2 | 9/2010 |

(Continued)

*Primary Examiner* — Spencer E. Bell

(74) *Attorney, Agent, or Firm* — Dority & Manning, P.A.

(57) ABSTRACT

A washing machine appliance includes a sump for collecting wash fluid, a water supply valve for supplying the wash fluid during a fill cycle, and a water level detection system including a pressure sensor for measuring sump pressures/fill levels. A controller is configured for operating the supply valve to fill the sump until a target volume is reached and obtaining a fill volume using the water level detection system. The controller determines that a fault condition exists based on a difference between the target volume and the fill volume, e.g., such as when the difference exceeds a predetermined fault threshold, and initiates a fault abatement process in response to determining that the fault condition exists.

16 Claims, 5 Drawing Sheets

(56) References Cited

U.S. PATENT DOCUMENTS

| | | | | |
|---|---|---|---|---|
| 7,930,786 | B2 | 4/2011 | La Belle et al. | |
| 7,958,584 | B2 | 6/2011 | Suel, II et al. | |
| 7,958,585 | B2 | 6/2011 | Zhang et al. | |
| 8,505,139 | B2 | 8/2013 | Vanhazebrouck et al. | |
| 9,206,538 | B2 | 12/2015 | Suel, II | |
| 9,410,280 | B2 | 8/2016 | Hettinger | |
| 9,840,805 | B2 | 12/2017 | Leonard et al. | |
| 2007/0266504 | A1 | 11/2007 | Xie et al. | |
| 2008/0172804 | A1* | 7/2008 | Vanhazebrouck | D06F 33/34 8/158 |
| 2009/0112513 | A1 | 4/2009 | Filippa | |
| 2010/0064445 | A1* | 3/2010 | Nieh | D06F 34/18 8/159 |
| 2014/0174547 | A1* | 6/2014 | Joo | D06F 33/34 137/2 |
| 2015/0113739 | A1 | 4/2015 | Pollett et al. | |
| 2018/0298549 | A1* | 10/2018 | Nam | D06F 58/10 |
| 2019/0120725 | A1 | 4/2019 | Yoon et al. | |
| 2020/0157725 | A1* | 5/2020 | Lv | D06F 33/42 |
| 2021/0054318 | A1* | 2/2021 | Piorkowski | C11D 17/046 |

FOREIGN PATENT DOCUMENTS

| | | | |
|---|---|---|---|
| CA | 2181879 | C | 4/2002 |
| CA | 2793083 | C | 9/2011 |
| CN | 1136350 | C | 1/2004 |
| CN | 1187017 | C | 2/2005 |
| CN | 201261837 | Y | 6/2009 |
| CN | 106544814 | A | 3/2017 |
| CN | 105466715 | A | 4/2018 |
| DE | 60126219 | T2 | 11/2007 |
| EP | 1505193 | A2 | 2/2005 |
| EP | 1580313 | B1 | 9/2005 |
| EP | 2382908 | A1 | 11/2011 |
| JP | H10295986 | A | 11/1998 |
| JP | 3297073 | B2 | 7/2002 |
| KR | 19990006535 | A | 1/1999 |
| KR | 100220275 | B1 | 9/1999 |
| KR | 100924445 | B1 | 11/2009 |
| KR | 100936965 | B1 | 1/2010 |
| WO | WO2019154297 | A1 | 8/2019 |

* cited by examiner

FAULT DETECTION FOR A WATER LEVEL DETECTION SYSTEM OF A WASHING MACHINE APPLIANCE

FIELD OF THE INVENTION

The present subject matter relates generally to washing machine appliances, or more specifically, to fault detection methods for a water level detection system of a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances may include water level detection systems for detecting the amount of water dispensed into the tub during a fill cycle or the amount of water remaining within the sump after a drain cycle. For example, water level detection systems may include pressure sensors coupled to pressure hoses on the sump for detecting the water pressure for determining the water level. Such systems can use this information to detect fill or drainage issues, such as a drain pump failure, and to ensure the ideal amount of water is in the tub for performing a particular wash cycle. However, in certain situations, the pressure sensor may become partially blocked or may otherwise malfunction, resulting in erroneous pressure readings and/or a delayed response. Failure to compensate for such variations in pressure readings can result in overfilling or underfilling the tub.

Accordingly, a washing machine appliance having improved water level detection systems would be desirable. More specifically, a water level detection system with fault detection would be particularly beneficial.

BRIEF DESCRIPTION OF THE INVENTION

Advantages of the invention will be set forth in part in the following description, or may be apparent from the description, or may be learned through practice of the invention.

In one aspect of the present disclosure, a washing machine appliance is provided including a sump for collecting wash fluid, a supply valve for providing a flow of the wash fluid into the sump during a fill cycle, a water level detection system comprising a pressure sensor fluidly coupled to the sump, and a controller operably coupled to the supply valve and the water level detection system. The controller is configured for operating the supply valve to provide the flow of wash fluid into the sump until a target volume is reached, obtaining a fill volume using the water level detection system, determining that a fault condition exists based on a difference between the target volume and the fill volume, and initiating a fault abatement process in response to determining that the fault condition exists.

In another aspect of the present disclosure, a method for operating a washing machine appliance is provided. The washing machine appliance includes a sump for collecting wash fluid, a water level detection system including a pressure sensor for measuring a sump pressure, and a supply valve for providing a flow of the wash fluid during a fill cycle. The method includes operating the supply valve to provide the flow of wash fluid into the sump until a target volume is reached, obtaining a fill volume using the water level detection system, determining that a fault condition exists based on a difference between the target volume and the fill volume, and initiating a fault abatement process in response to determining that the fault condition exists.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
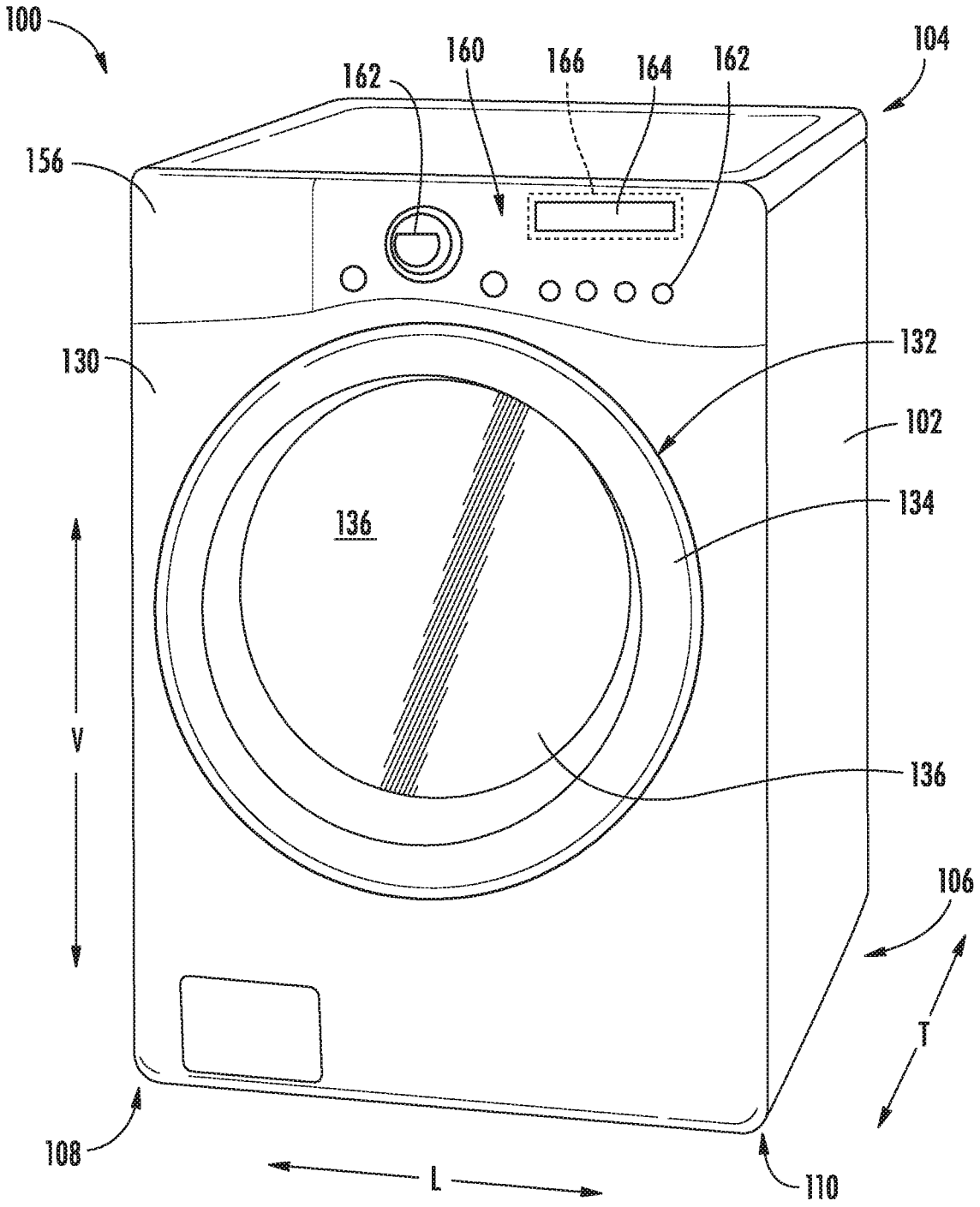
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
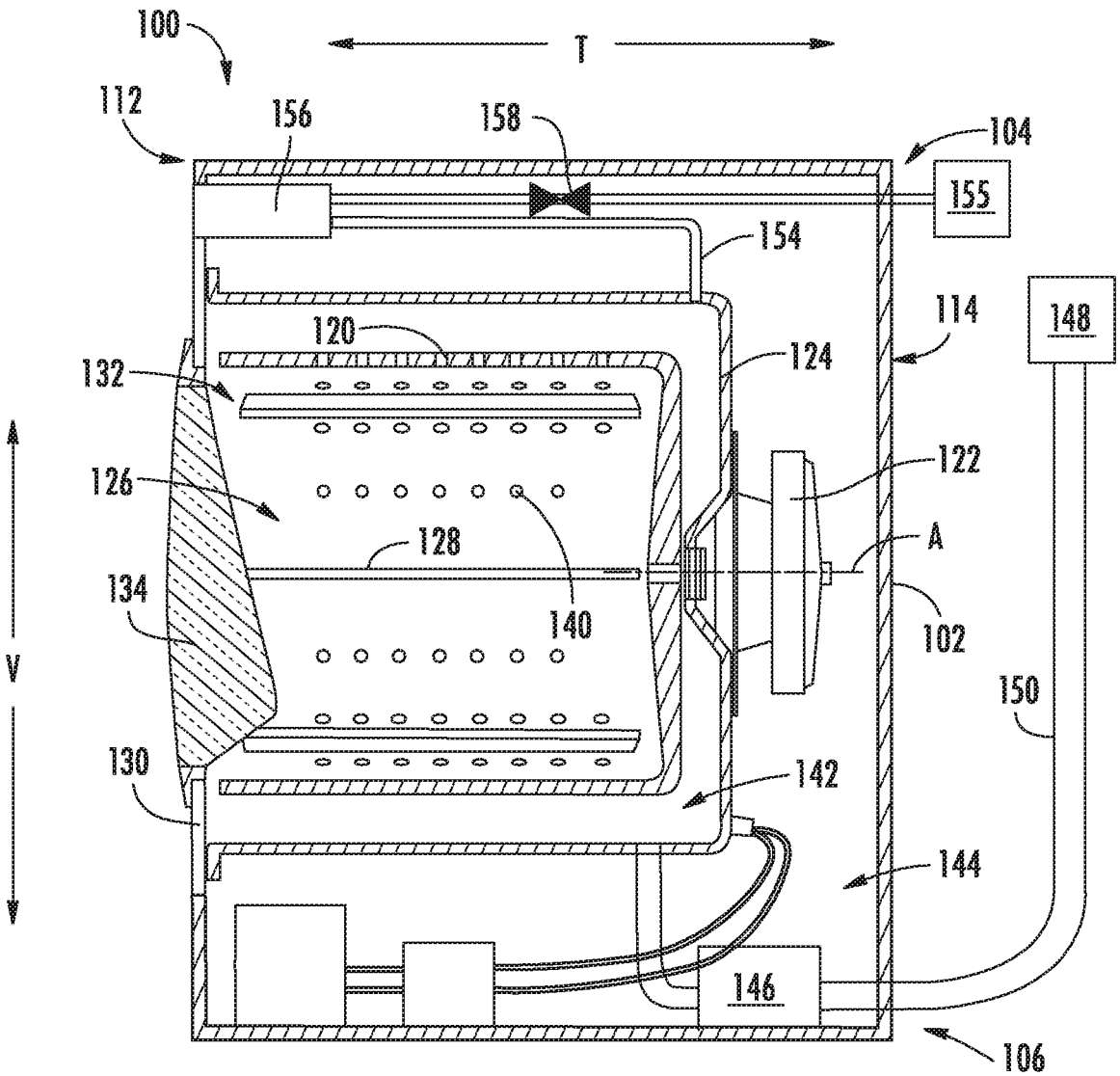
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into wash tub 124. For example, spout 154 may be in fluid communication with a water supply 155 (FIG. 2) in order to direct fluid (e.g., clean water or wash fluid) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 154 to facilitate the complete and accurate dispensing of wash additive.

In addition, a water supply valve 158 may provide a flow of water from a water supply source (such as a municipal water supply 155) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Figure 3:
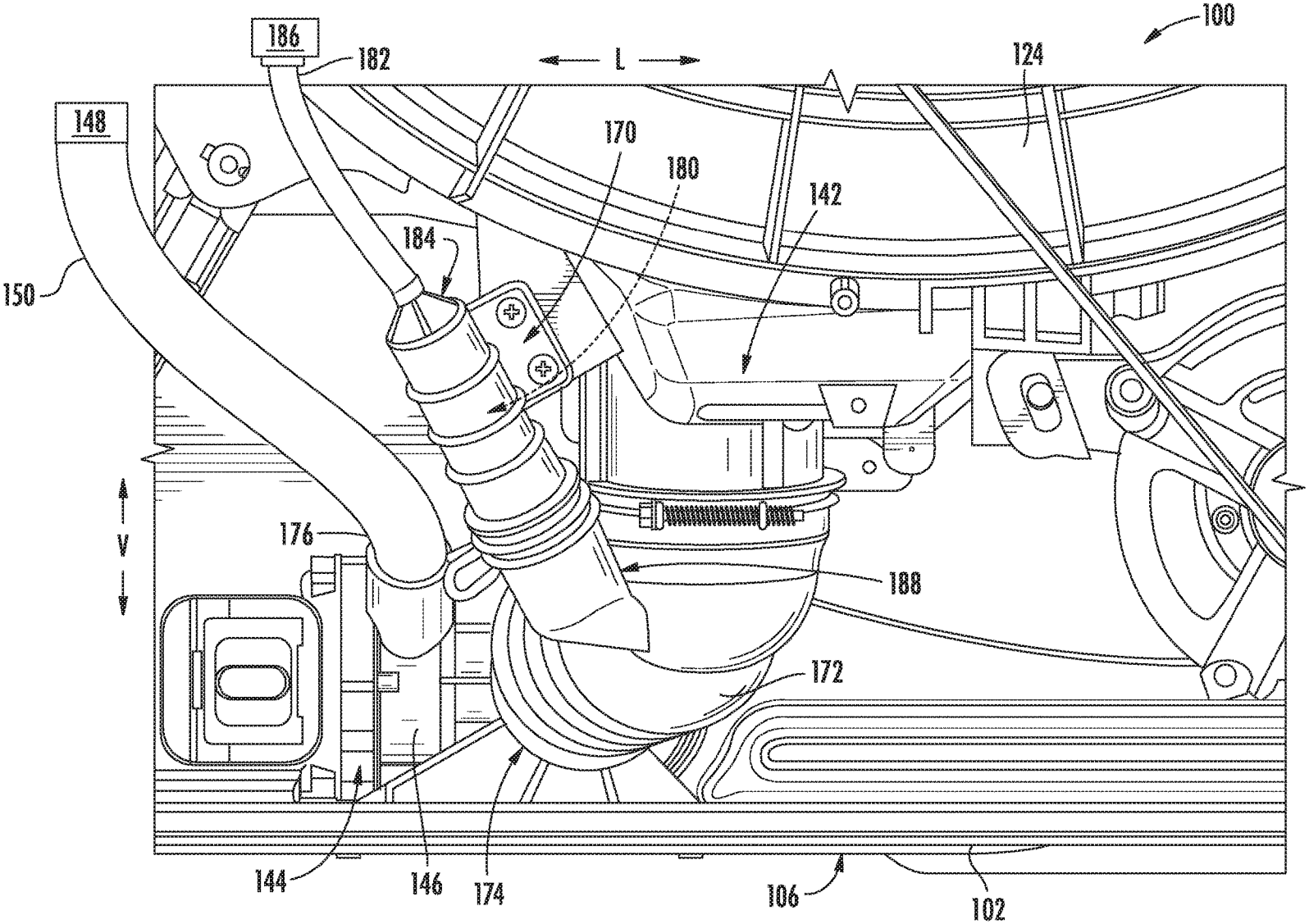
FIG. 3 provides a rear, perspective view of a drain pump assembly and a water level detection system according to an exemplary embodiment of the present subject matter.
Figure 4:
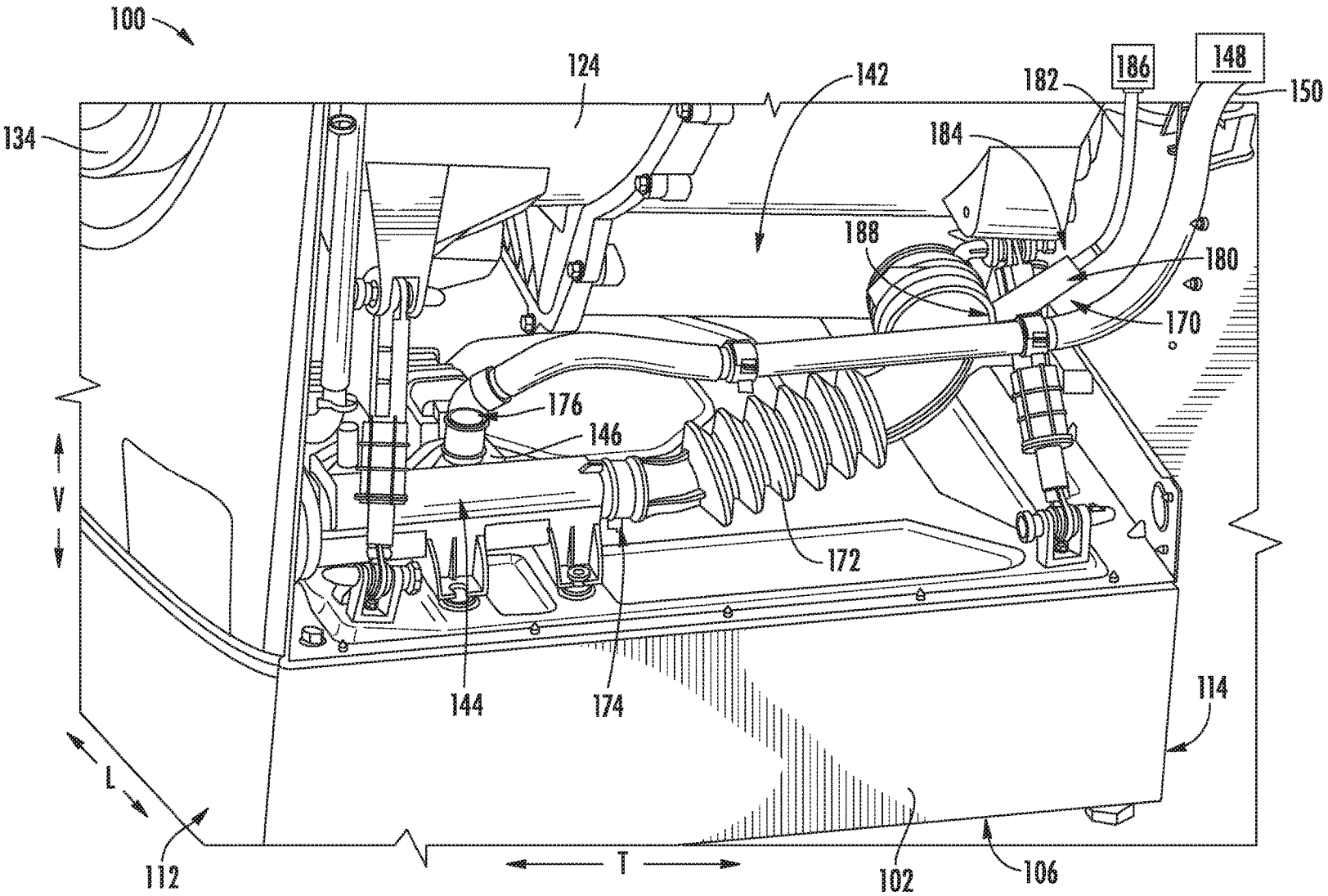
FIG. 4 provides a side, perspective view of the exemplary drain pump assembly and water level detection system of FIG. 3.

Referring now to FIGS. 3 and 4, a water level detection system 170 that may be used within washing machine appliance 100 will be described according to an exemplary embodiment. Specifically, FIGS. 3 and 4 provide rear perspective and side perspective views, respectively, of water level detection system 170 operably coupled to a drain pump assembly (e.g., drain pump assembly 144). However, water level detection system 170 as described herein is only one exemplary configuration used for the purpose of explaining aspects of the present subject matter and is not intended to limit the scope of the invention in any manner.

As illustrated, sump 142 defines a drain basin at a lowest point of wash tub 124 for collecting wash fluid under the force of gravity. A sump hose 172 extends between sump 142 and an intake 174 of drain pump 146. According to the illustrated embodiment, drain pump 146 is a positive displacement pump configured for urging wash fluid that collects in sump 142 and sump hose 172 through a pump discharge 176, through drain hose 150, and to external drain 148. However, it should be appreciated that the drain pump assembly 144 and the sump drainage configuration illustrated herein are only exemplary and not intended to limit the scope of the present subject matter. For example, drain pump 146 may have a different configuration or position, may include one or more filtering mechanisms, etc.

Water level detection system 170 may generally include an air chamber 180 that extends from sump hose 172 (or another suitable portion of sump 142) at least partially upward along the vertical direction V. A pressure hose 182 is fluidly coupled to a top end 184 of air chamber 180 and extends to a pressure sensor 186. In general, pressure sensor 186 may be any sensor suitable for determining a water level within sump 142 based on pressure readings. For example, pressure sensor 186 may be a piezoelectric pressure sensor and thus may include an elastically deformable plate and a piezoresistor mounted on the elastically deformable plate. According to exemplary embodiments, pressure sensor 186 is positioned proximate top 104 of cabinet 102, e.g., proximate or mounted to control panel 160. Thus, pressure hose 182 extends from air chamber 180 (i.e., proximate bottom 106 of cabinet 102) upward along the vertical direction V to pressure sensor 186.

Water level detection system 170 and pressure sensor 186 generally operate by measuring a pressure of air within air chamber 180 and using the measured chamber pressure to estimate the water level in sump 142. For example, when the water level within sump 142 falls below a chamber inlet 188, the pressure within air chamber 180 normalizes to ambient or atmospheric pressure, and thus reads a zero pressure. However, when water is present in sump 142 and rises above chamber inlet 188, the measured air pressure becomes positive and may increase proportionally with the water level. Although sump 142 is described herein as containing water, it should be appreciated that aspects of the present subject matter may be used for detecting the level of any other suitable wash fluid.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 5:
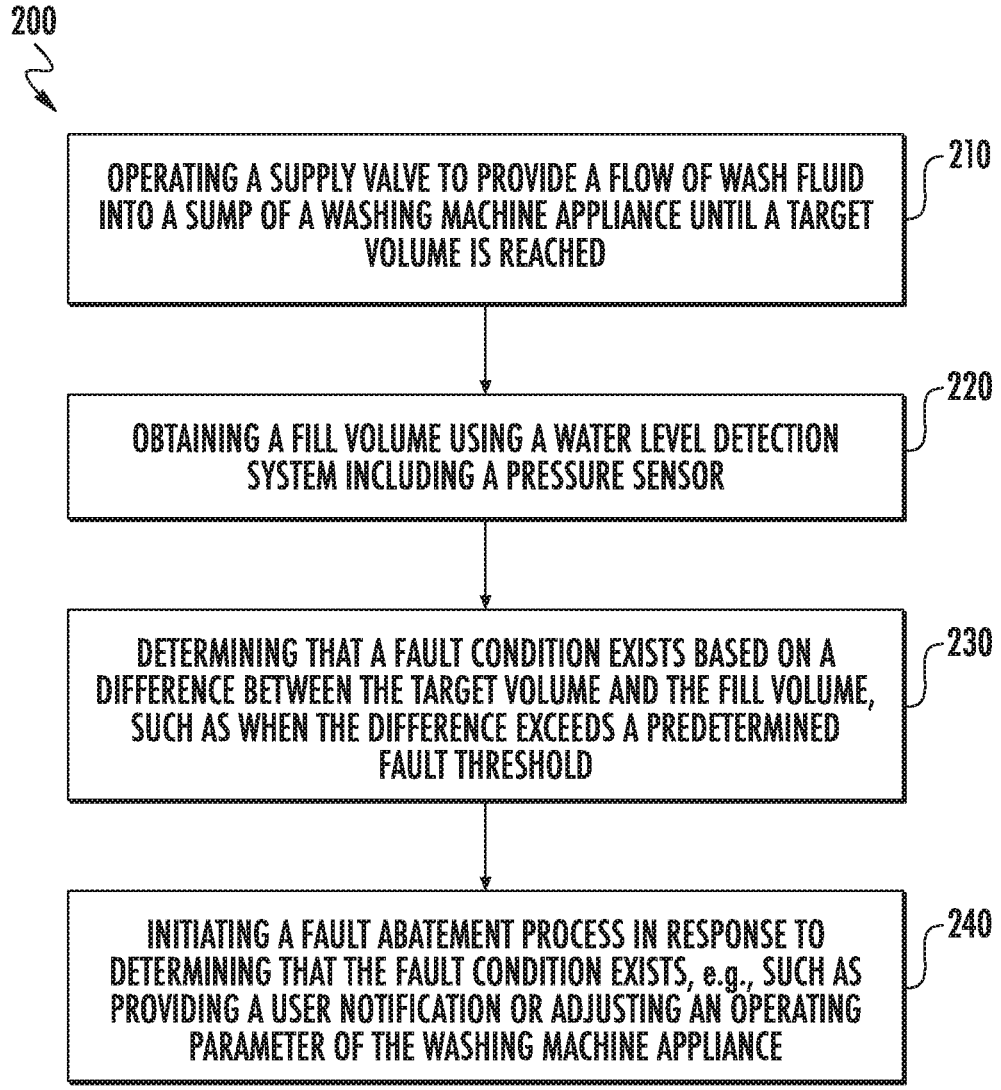
FIG. 5 illustrates a method for controlling a washing machine appliance in accordance with one embodiment of the present disclosure.

Referring now to FIG. 5, method 200 includes, at step 210, operating a supply valve to provide a flow of wash fluid into a sump of a washing machine appliance until a target volume is reached. In this regard, continuing the example from above, water supply valve 158 may be opened to direct water from water supply 155 directly into wash tub 124. According to an exemplary embodiment, water may be provided into or through detergent drawer 156 where the water may mix with detergent to form wash fluid that flows into sump 142. It should be appreciated that the terms water, wash fluid, and the like may be used interchangeably herein.

As used herein, the term "target volume" is generally intended to refer to the amount of water or wash fluid that controller 166 determines has been dispensed into sump 142 based at least in part on the operation of water supply valve 158. For example, according to an exemplary embodiment, the flow rate of water supply valve 158 may be approximated based on factors such as supply water pressure, valve model or configuration, empirical data, theoretical data, flow models, or any other suitable factors. For example, water supply valve 158 may be a fixed flow valve that provides a relatively constant flow rate of wash fluid when water supply 155 is maintained at a suitably high pressure, e.g., such as in the case of a municipal water supply. Thus, by knowing when water supply valve 158 is open and closed along with the flow rate of wash fluid from water supply valve 158, controller 166 may calculate the amount of fluid dispensed and determine a target time that the water supply valve 158 should be opened to supply the target volume of wash fluid.

Specifically, step 210 may include opening the supply valve to provide the flow of wash fluid into the sump, determining a target time that the supply valve should be opened to provide the target volume, and closing the supply valve after the target time has lapsed. According to an exemplary embodiment, controller 166 may divide the target volume by the known flow rate to determine how long water supply valve 158 should be opened. For example, if the target volume is 9 gallons and the valve flow rate is 3 gallons per minute, the target time for water supply valve would be 3 minutes. Although the target volume is described above as being 9 gallons, it should be appreciated that the target volume may be any suitable volume or water level within sump 142, e.g., selected to prevent overfilling of sump 142. According to exemplary embodiments, the target volume may be between about 2 and 15 gallons, between about 4 and 13 gallons, between about 7 and 11 gallons, etc.

Step 220 includes obtaining a fill volume using a water level detection system. As used herein, the term "fill volume" is generally intended to refer to the level or amount of wash fluid measured by the water level detection system 170. In this regard, continuing the example from above, pressure sensor 186 of water level detection system 170 may be used to monitor sump pressures as wash fluid is being added to sump 142. Sump pressures may then be correlated to the volume or level of water or wash fluid within sump 142, e.g., as described above. It should be appreciated that as used herein, the terms volume, level, height, weight, and similar terms may be used interchangeably to refer to the amount of wash fluid within sump 142. For example, other proxies, substitutes, or parameters may be indicative of these volumes while remaining within scope of the present subject matter, such as a target weight of water, a target fill level or height, or a water pressure generated at pressure sensor 186 by the wash fluid in wash tub 124. It should be appreciated that controller 166 may be programmed with algorithms or transfer functions for correlating such parameters as is known in the art.

Step 230 includes determining that a fault condition exists based on a difference between the target volume and the fill volume. As explained above, a partially blocked or otherwise defective pressure sensor typically results in a lag in the sump pressure measurements or otherwise inaccurate measurements. As a result, when pressure measurements are converted to volume measurements or fill levels, these erroneous measurements may result in overfilling wash tub 124. Aspects of the present subject matter are directed to methods for performing a fill cycle of a washing machine appliance and detecting a faulty pressure sensor, such that corrective action may be taken, thus reducing the likelihood of overfilling the tub or otherwise generating operability issues with washing machine appliance 100.

Although the fault condition is described above as being triggered based on a difference between the target volume and the fill volume, it should be appreciated that a mathematical difference need not be calculated. For example, according to exemplary embodiments, determining that the fault condition exists may include determining that the target volume has reached a first predetermined threshold and determining that the fill volume is below a second predetermined threshold. For example, the second predetermined threshold may be less than the first predetermined threshold, such that a fault condition is triggered when the actual amount of water within wash tub 124 is less than that expected based on the time that water supply valve 158 has been opened. Other suitable methods for detecting a deviation between the target volume and the fill volume are possible and within the scope of the present subject matter.

It should be appreciated that according to exemplary embodiments, any deviation between the target volume (i.e., the amount of water that should be sump 142 based on the fill time) and the fill volume (i.e., as measured by water level detection system 170) may indicate an inaccuracy of pressure sensor 186 and/or an inaccurate assumption of the valve flow rate. In order to prevent nuisance trips, a fault condition may be triggered only when the difference between the target volume and the fill volume exceeds a predetermined fault threshold. The predetermined fault threshold may be any volume or difference in water level measurements suitable for a particular application, overflow sensitivities, etc. According to an exemplary embodiment, the predetermined fault threshold may be between about 0.5 and 4 gallons, between about 1 and 3 gallons, or about 2 gallons. Other suitable fault thresholds are possible and within scope of the present subject matter.

Step 230 may further include a debounce or nuisance avoidance procedure to avoid nuisance trips or erroneous triggering of the fault condition. In this regard, for example, step 230 may include (a) obtaining the target volume and the fill volume (e.g., as described above); (b) incrementing a fault counter if the difference between the target volume and the fill volume exceeds a predetermined fault threshold; (c) repeating steps (a)-(b) if the fault counter is less than a predetermined count threshold; and (d) determining that the fault condition exists when the fault counter reaches the predetermined count threshold. In this regard, for example, the target volume and fill volume may be obtained at a predetermined interval, such as one measurement per second, and a fault condition may be triggered only if a certain number of consecutive measurements results in a difference that exceeds the predetermined fault threshold. For example, the predetermined count threshold may be five consecutive measurements, 10 consecutive measurements, 20 consecutive measurements, or any other suitable number and frequency of measurements.

Furthermore, according to exemplary embodiments, the fault counter may be reset anytime sump 142 is emptied or drain pump 146 is otherwise activated. In addition, or alternatively, the fault counter may be reset when the difference between the target volume and the fill volume drops below the predetermined fault threshold. It should be appreciated that other suitable fault thresholds, counter thresholds, and other nuisance trip avoidance procedures may be used while remaining within the scope of the present subject matter.

Step 240 includes initiating a fault abatement process in response to determining that the fault condition exists. This regard, when a fault condition exists, e.g., indicating a potentially bad pressure sensor 186, it may be desirable to contact a maintenance technician, provide a user notification, reduce the water fill level, drain the sump 142, or take other corrective action to prevent operability issues or overfilling of sump 142. For example, step 240 may include providing a user notification after determining that the fault condition exists, e.g., via display 164, via communication with an external device, or in any other suitable manner. In addition, the user notification may include a recommendation to schedule a service call, order a new part, or perform other corrective action.

In addition, step 240 may include adjusting at least one operating parameter of the washing machine appliance in response to detecting a fault condition. As used herein, an "operating parameter" of washing machine appliance 100 is any cycle setting, operating time, component setting, spin speed, part configuration, or other operating characteristic that may affect the performance of washing machine appliance 100. Thus, references to operating parameter adjustments or "adjusting at least one operating parameter" are intended to refer to control actions intended to improve system performance based on the fault condition or other system parameters. For example, adjusting an operating parameter may include adjusting an additive dispense amount, adjusting an agitation time or an agitation profile, adjusting a water level, limiting a spin speed of wash basket 120, etc. In addition, adjusting an operating parameter may include stopping the operation of washing machine appliance 100, operating the drain pump 146 to discharge wash fluid from the sump 142, or any other suitable control action. Other operating parameter adjustments are possible and within the scope of the present subject matter.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a sump for collecting wash fluid;

a supply valve for providing a flow of the wash fluid into the sump during a fill cycle;

a water level detection system comprising a pressure sensor fluidly coupled to the sump; and a controller operably coupled to the supply valve and the water level detection system, the controller being configured for:

opening the supply valve to provide the flow of the wash fluid into the sump;

approximating a flow rate of the flow of the wash fluid through the supply valve based at least in part on a supply water pressure;

determining a target time that the supply valve should be opened to provide a target volume of the wash fluid into the sump by dividing the target volume by the flow rate;

closing the supply valve after the target time has lapsed;

obtaining a fill volume using the water level detection system;

determining that a fault condition exists based on a difference between the target volume and the fill volume; and initiating a fault abatement process in response to determining that the fault condition exists, wherein initiating the fault abatement process comprises limiting a spin speed of a wash basket.

2. The washing machine appliance of claim 1, wherein the target volume is approximately 9 gallons.

3. The washing machine appliance of claim 1, wherein obtaining the fill volume using the water level detection system comprises:

obtaining a sump pressure using the pressure sensor of the water level detection system; and determining the fill volume from the sump pressure.

4. The washing machine appliance of claim 1, wherein determining that the fault condition exists comprises:

determining that the difference between the target volume and the fill volume exceeds a predetermined fault threshold.

5. The washing machine appliance of claim 4, wherein the predetermined fault threshold is 1 gallon.

6. The washing machine appliance of claim 1, wherein determining that the fault condition exists based on the difference between the target volume and the fill volume comprises:

determining that the target volume has reached a first predetermined threshold; and determining that the fill volume is below a second predetermined threshold, the second predetermined threshold being less than the first predetermined threshold.

7. The washing machine appliance of claim 1, wherein determining that the fault condition exists based on the difference between the target volume and the fill volume comprises:

(a) obtaining the target volume and the fill volume;

(b) incrementing a fault counter if the difference between the target volume and the fill volume exceeds a predetermined fault threshold;

(c) repeating steps (a)-(b) if the fault counter is less than a predetermined count threshold; and (d) determining that the fault condition exists when the fault counter reaches the predetermined count threshold.

8. The washing machine appliance of claim 7, wherein the fault counter is reset when a drain pump is energized or when the difference between the target volume and the fill volume is less than the predetermined fault threshold.

9. The washing machine appliance of claim 1, wherein initiating the fault abatement process comprises:

providing a user indication of the fault condition.

10. The washing machine appliance of claim 1, wherein initiating the fault abatement process comprises:

adjusting at least one operating parameter of the washing machine appliance.

11. The washing machine appliance of claim 10, wherein adjusting at least one operating parameter of the washing machine appliance comprises:

operating a drain pump to discharge the wash fluid from the sump.

12. A method for operating a washing machine appliance, the washing machine appliance comprising a sump for collecting wash fluid, a water level detection system including a pressure sensor for measuring a sump pressure, a supply valve for providing a flow of the wash fluid during a fill cycle, the method comprising:

opening the supply valve to provide the flow of the wash fluid into the sump;

approximating a flow rate of the flow of the wash fluid through the supply valve based at least in part on a supply water pressure;

determining a target time that the supply valve should be opened to provide a target volume of the wash fluid into the sump by dividing the target volume by the flow rate;

closing the supply valve after the target time has lapsed;

obtaining a fill volume using the water level detection system;

determining that a fault condition exists based on a difference between the target volume and the fill volume; and initiating a fault abatement process in response to determining that the fault condition exists, wherein initiating the fault abatement process comprises limiting a spin speed of a wash basket.

13. The method of claim 12, wherein obtaining the fill volume using the water level detection system comprises:

obtaining a sump pressure using the pressure sensor of the water level detection system; and determining the fill volume from the sump pressure.

14. The method of claim 12, wherein determining that the fault condition exists comprises:

determining that the difference between the target volume and the fill volume exceeds a predetermined fault threshold.

15. The method of claim 12, wherein determining that the fault condition exists based on the difference between the target volume and the fill volume comprises:

(a) obtaining the target volume and the fill volume;

(b) incrementing a fault counter if the difference between the target volume and the fill volume exceeds a predetermined fault threshold;

(c) repeating steps (a)-(b) if the fault counter is less than a predetermined count threshold; and (d) determining that the fault condition exists when the fault counter reaches the predetermined count threshold.

16. The method of claim 15, wherein the fault counter is reset when a drain pump is energized or when the difference between the target volume and the fill volume is less than the predetermined fault threshold.

* * * * *